US012163346B2

(12) United States Patent
Bradley

(10) Patent No.: US 12,163,346 B2
(45) Date of Patent: Dec. 10, 2024

(54) ANCHOR BOLT PLACEMENT TOOL

(71) Applicant: Andrew Jonathan Bradley, Branford, FL (US)

(72) Inventor: Andrew Jonathan Bradley, Branford, FL (US)

( * ) Notice: Subject to any disclaimer, the term of this patent is extended or adjusted under 35 U.S.C. 154(b) by 0 days.

(21) Appl. No.: 18/310,270

(22) Filed: May 1, 2023

(65) Prior Publication Data

US 2023/0349179 A1 Nov. 2, 2023

Related U.S. Application Data

(60) Provisional application No. 63/363,835, filed on Apr. 29, 2022.

(51) Int. Cl.
*E04G 21/18* (2006.01)

(52) U.S. Cl.
CPC ..... *E04G 21/185* (2013.01)

(58) Field of Classification Search
CPC ..... E04G 21/185
USPC ..... 248/309.1, 544, 546
See application file for complete search history.

(56) References Cited

U.S. PATENT DOCUMENTS

| | | | | |
|---|---|---|---|---|
| 5,035,061 A * | 7/1991 | Bradbury | B23Q 9/0028 | 30/373 |
| 7,739,806 B1 * | 6/2010 | Pater | B25H 7/02 | 33/417 |
| 8,136,260 B1 * | 3/2012 | Jones | G01B 5/24 | 33/562 |
| 11,359,394 B2 * | 6/2022 | Dicaire | B25H 7/04 | |
| 11,628,679 B2 * | 4/2023 | Robin | B43L 13/02 | 33/474 |

FOREIGN PATENT DOCUMENTS

JP H1150465 A * 2/1999

* cited by examiner

*Primary Examiner* — Anita M King
(74) *Attorney, Agent, or Firm* — Squire Patent Consulting & IP Law LLC; Brendan E. Squire

(57) ABSTRACT

An anchor bolt alignment tool provides for accurate placement and alignment of an anchor bolt in a substrate in multiple axes and dimensions simultaneously. The anchor bolt alignment tool has a base that may be formed as a flat plate having a top surface and a bottom surface, with the bottom surface arranged for placement and alignment with a surface of a substrate. A lateral alignment guide is oriented orthogonal to the bottom surface in each of a vertical and a longitudinal axis of the base. A vertical alignment guide is oriented orthogonal to the top surface of the base in each of a vertical and a lateral axis of the base. An inboard edge of the vertical alignment guide and a notch in the base provide for alignment of an axial centerline of the anchor bolt at the desired lateral offset from the edge of the substrate.

12 Claims, 9 Drawing Sheets

ANCHOR BOLT PLACEMENT TOOL

CROSS-REFERENCE TO RELATED APPLICATIONS

This application claims the benefit of priority of U.S. provisional application No. 63/363,835, filed Apr. 29, 2022, the contents of which are herein incorporated by reference.

BACKGROUND OF THE INVENTION

The present invention relates to anchor bolts, and more particularly to anchor bolt placement for concrete construction.

Placement of anchor bolts in concrete construction can be a difficult task. Preferably, the anchor bolts are placed at a specified distance from a side edge of a poured concrete slab, or section of a slab. Likewise, the anchor bolt should be positioned at a specified longitudinal distance of the concrete slab. In addition, the threads of the anchor bolt should also be set at a specified vertical distance from the surface of the concrete. Ideally, the anchor bolt should also be positioned so that is orthogonal to the surface of the concrete. If the anchor bolt is not properly aligned and placed, significant delays in subsequent steps of the construction can ensue after the concrete has set.

Existing tools and methods require the construction worker to measure each of the specified distances and alignments individually, such as with a tape measure and a T-square. As the worker changes from one tool to the next, the placement and/or alignment of the anchor bolt from a previous measurement or alignment can occur as the worker repositions and aligns the anchor bolt for the next dimension.

As can be seen, there is a need for improved apparatus and methods for placement and alignment of anchor bolts, particularly in concrete construction.

SUMMARY OF THE INVENTION

In one aspect of the present invention, an anchor bolt alignment tool is disclosed. The anchor bolt alignment tool includes a base formed as a plate having a top surface and a bottom surface. The bottom surface is arranged for placement with a top surface of a substrate. A lateral alignment guide extends downwardly from the bottom surface of the base. The lateral alignment guide has a flat inner surface oriented orthogonal to the bottom surface of the base. A vertical alignment guide extends upwardly from the top surface of the base. A notch is defined in the base. The notch has a width corresponding to a diameter of an anchor bolt to be aligned by the anchor bolt alignment tool.

In some embodiments, one or more graduated markings are disposed in a spaced apart relation along the vertical alignment guide.

In some embodiments, a gripping portion disposed on at least one of a front surface and a back surface of the vertical alignment guide. The gripping portion may include a plurality of protrusions extending from the at least one of the front surface and the back surface of the vertical alignment guide.

In some embodiments, the notch is disposed at a desired lateral offset of the anchor bolt from the lateral alignment guide.

In some embodiments, an inboard edge of the vertical alignment guide is aligned with a side edge of the notch.

In other aspects of the invention, an anchor bolt alignment tool is disclosed. The anchor bolt alignment tool includes a base having a bottom surface arranged for a horizontal alignment with a top surface of a substrate. A lateral alignment guide is arranged for a vertical alignment with a side edge of the substrate. The lateral alignment guide is oriented orthogonal to the bottom surface of the base. A vertical alignment guide is elevated from a top surface of the base. A notch is defined in the base and is disposed at a desired lateral offset from the lateral alignment guide.

In some embodiments, one or more graduated markings are vertically disposed in a spaced apart relation along the vertical alignment guide.

In some embodiments, a gripping portion is disposed on at least one of a front surface and a back surface of the vertical alignment guide. The he gripping portion includes a plurality of protrusions extending from the at least one of the front surface and the back surface of the vertical alignment guide.

In some embodiments, the lateral alignment guide is adjustably coupled with the base.

In some embodiments, an inboard edge of the vertical alignment guide is aligned with a side edge of the notch.

In other aspects of the invention, a method of setting an anchor bolt in a substrate is disclosed. The method includes positioning a lateral alignment guide of an anchor bolt alignment tool in abutment with one of a side edge of the substrate or a framing member of the substrate. A bottom end of the anchor bolt is embedded in the substrate. An intermediate section of the anchor bolt is positioned within a notch defined in a base of the anchor bolt alignment tool, with the notch positioned at a desired lateral spacing from lateral alignment guide. A top end of the anchor bolt is positioned in an upright orientation.

In some embodiments, the method may include aligning an axial length of the anchor bolt with a side edge of a vertical alignment guide, such that the axial length of the anchor bolt is orthogonal with a top surface of the substrate.

In some embodiments, the method includes setting the top end of the anchor bolt at a desired vertical elevation above a top surface of the substrate, by alignment of the top end of the anchor bolt with a selected one of one or more graduated markings disposed in a spaced apart relation along the vertical alignment guide.

In some embodiments, the method includes repositioning the anchor bolt alignment tool along one of the side edge of the substrate or the framing member of the substrate. A bottom end of a subsequent anchor bolt is then embedded in the substrate. An intermediate section of the subsequent anchor bolt is positioned within the notch with a top end of the subsequent anchor bolt in an upright orientation.

In some embodiments, the method may also include adjusting a lateral position of the lateral alignment guide, relative to the base.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention.

Broadly, embodiments of the present invention provide an anchor bolt alignment and positioning tool. The anchor bolt alignment and positioning tool provides for accurate placement and alignment of an anchor bolt in multiple axes and dimensions simultaneously. The anchor bolt alignment tool is particularly useful in the placement and alignment of anchor bolts in a poured concrete slab, before the concrete has set.

Figure 1:
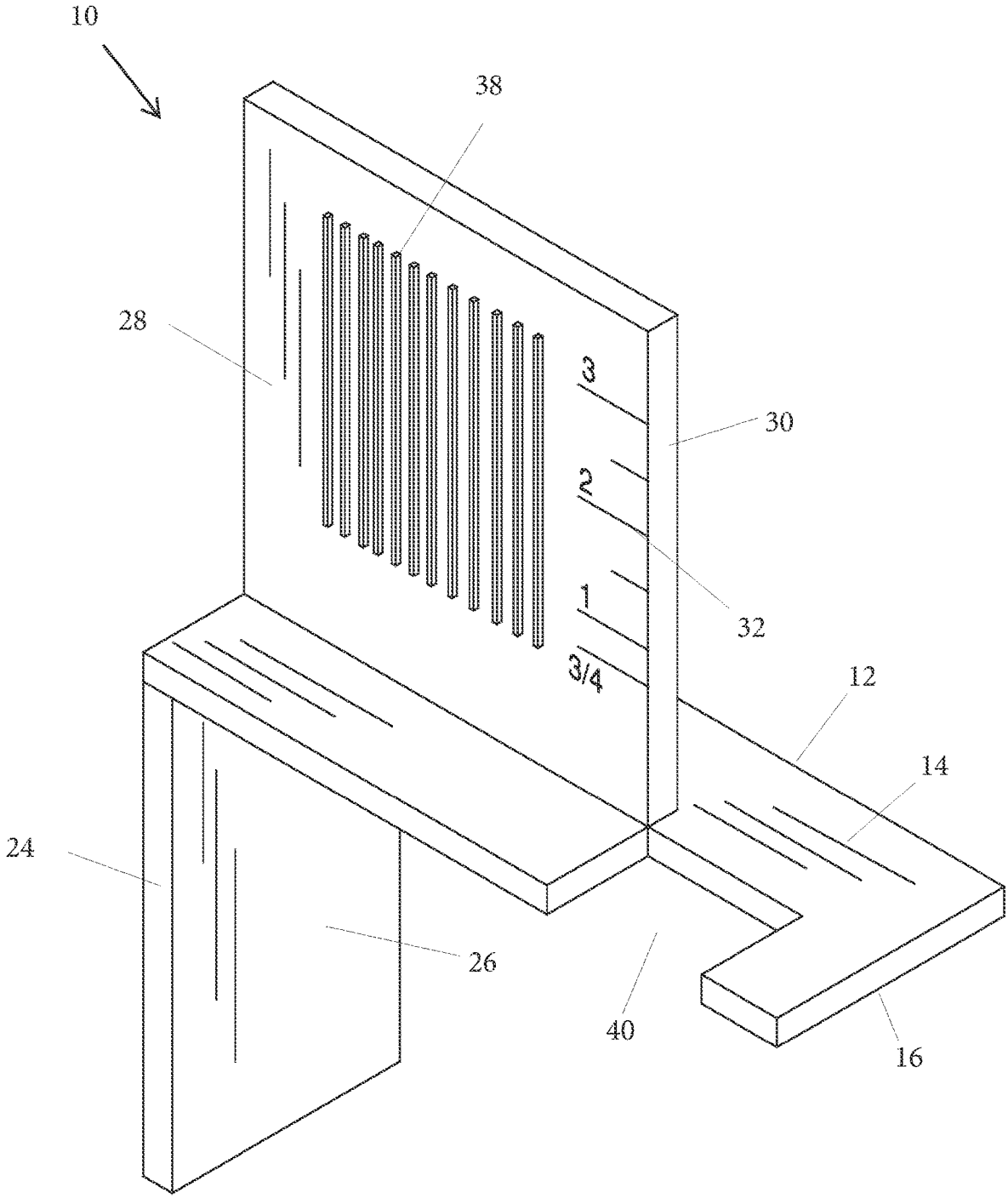
FIG. 1 is a front perspective view of an anchor bolt alignment tool.
Figure 2:
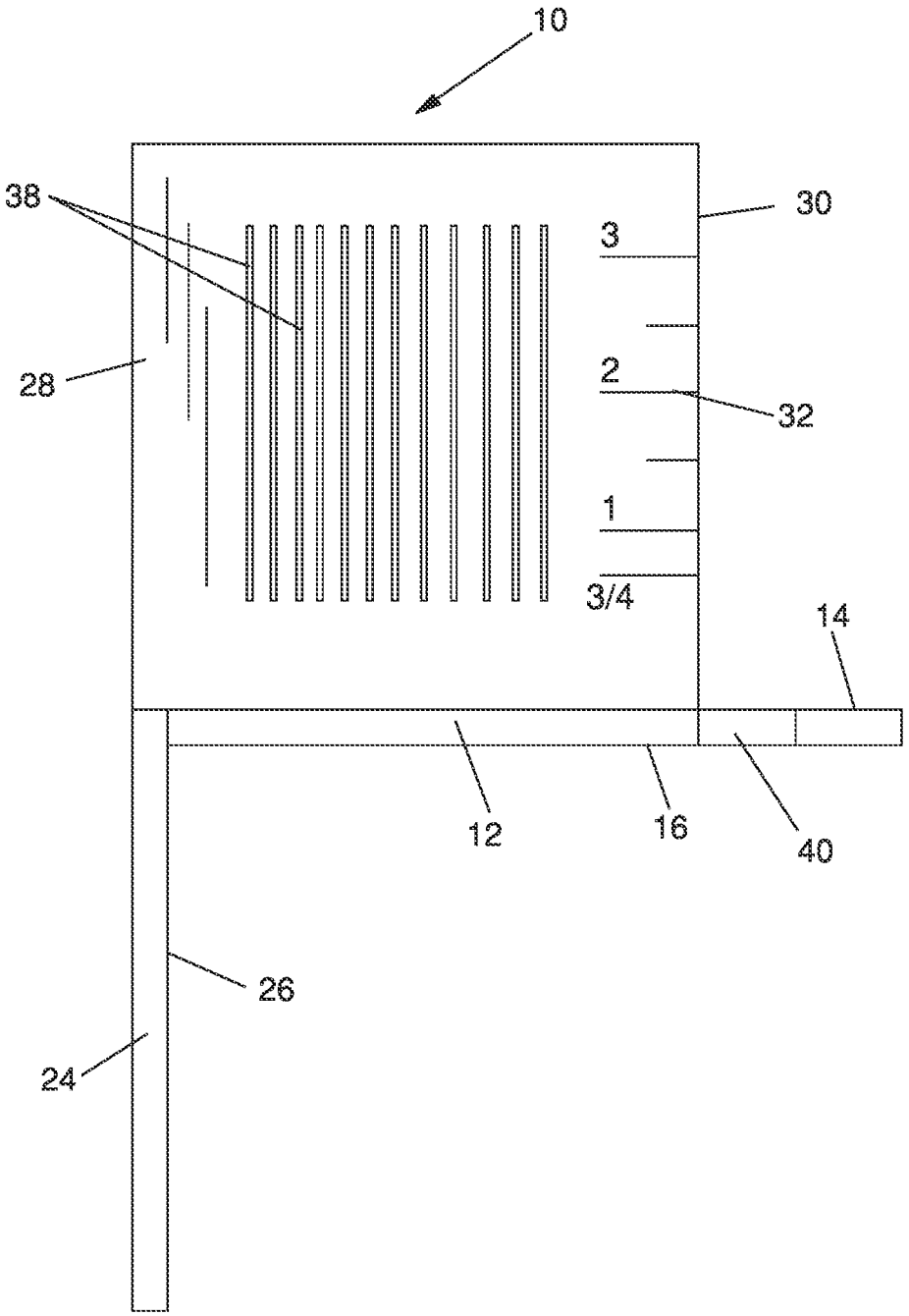
FIG. 2 is a right side elevation view of the anchor bolt alignment tool.
Figure 3:
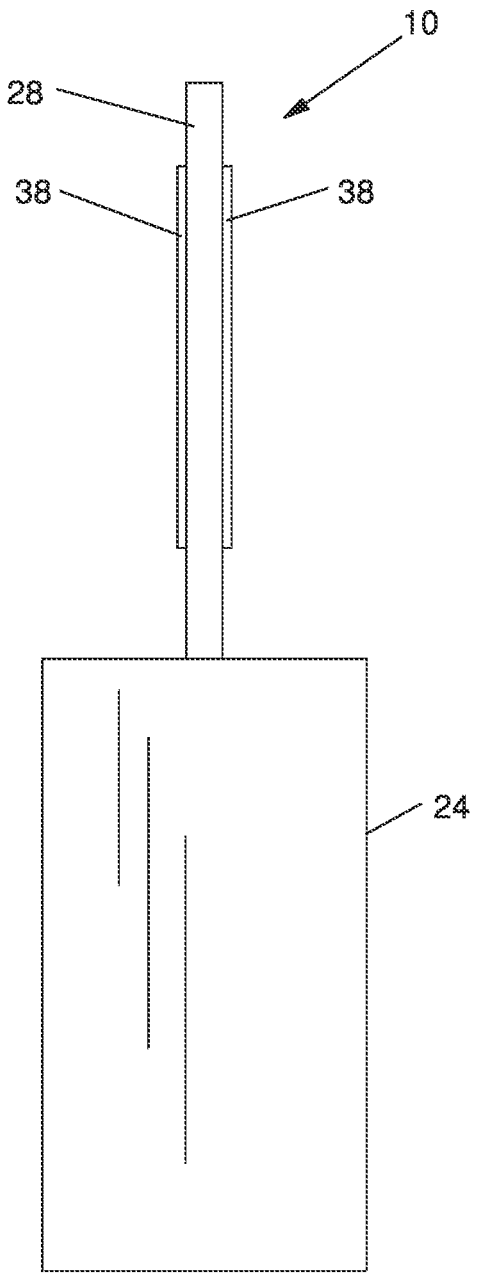
FIG. 3 is a rear elevation view of the anchor bolt alignment tool.
Figure 4:
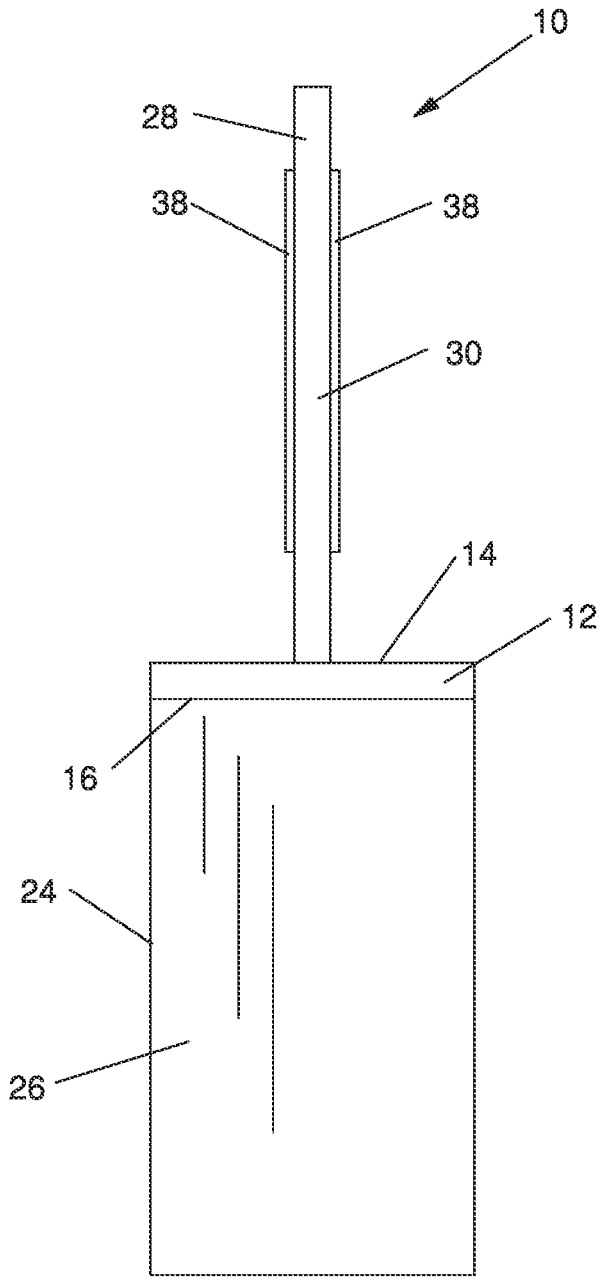
FIG. 4 is a front elevation view of the anchor bolt alignment tool.
Figure 5:
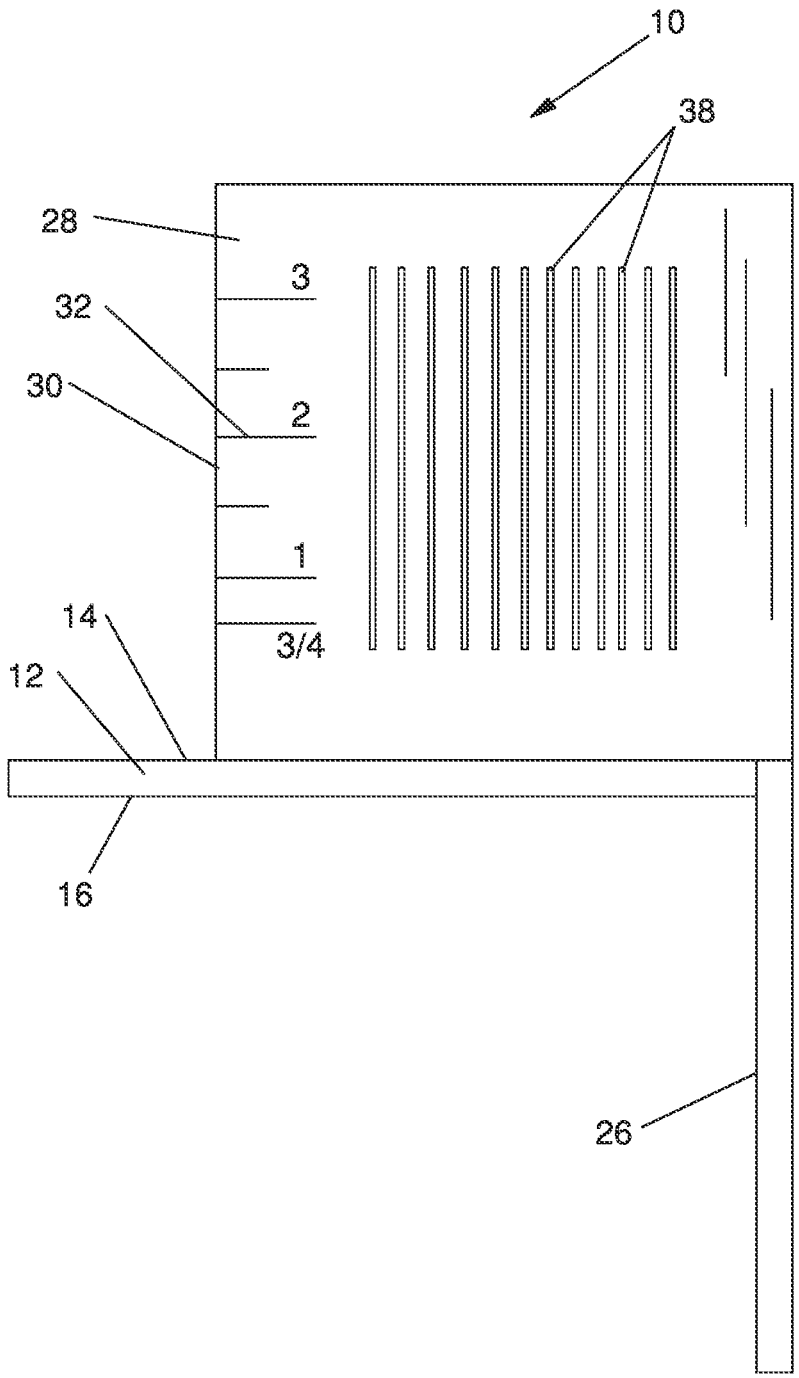
FIG. 5 is a left side elevation view of the anchor bolt alignment tool.
Figure 6:
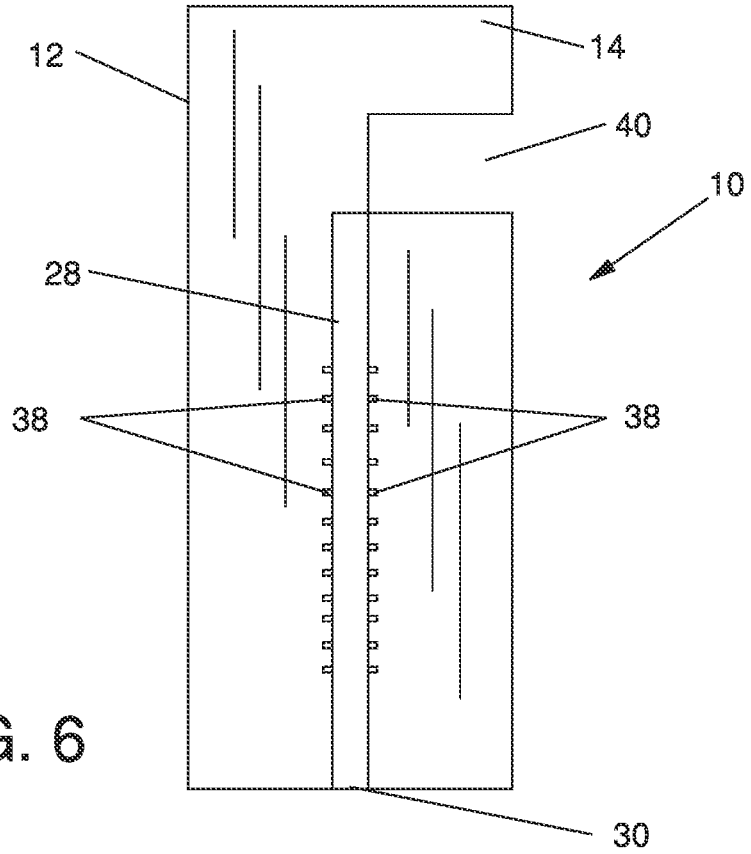
FIG. 6 is a top plan view of the anchor bolt alignment tool.
Figure 7:
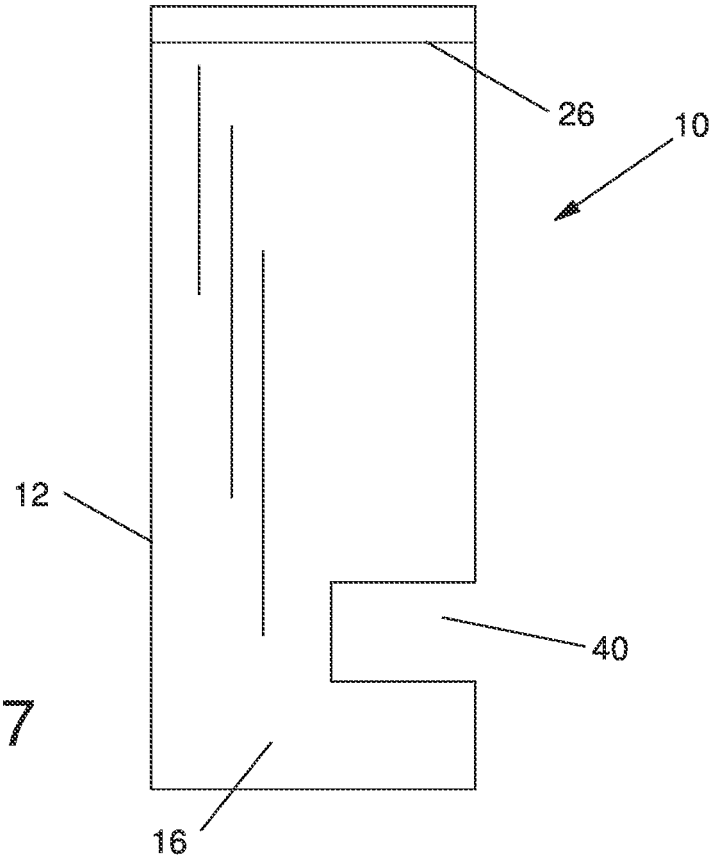
FIG. 7 is a bottom plan view of the anchor bolt alignment tool.
Figure 8:
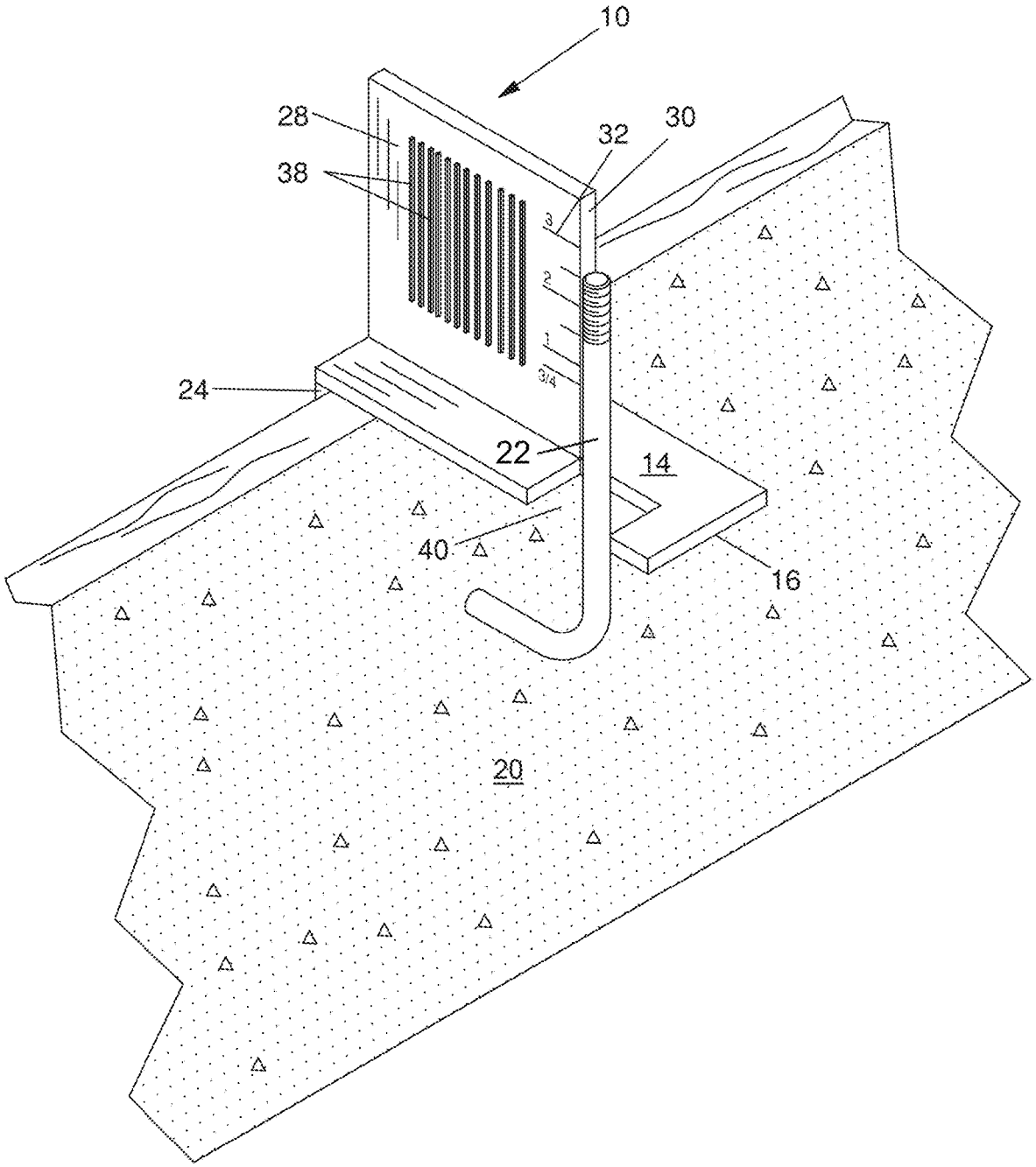
FIG. 8 is a perspective view of the anchor bolt alignment tool shown in use placing an anchor bolt in a concrete foundation.
Figure 9:
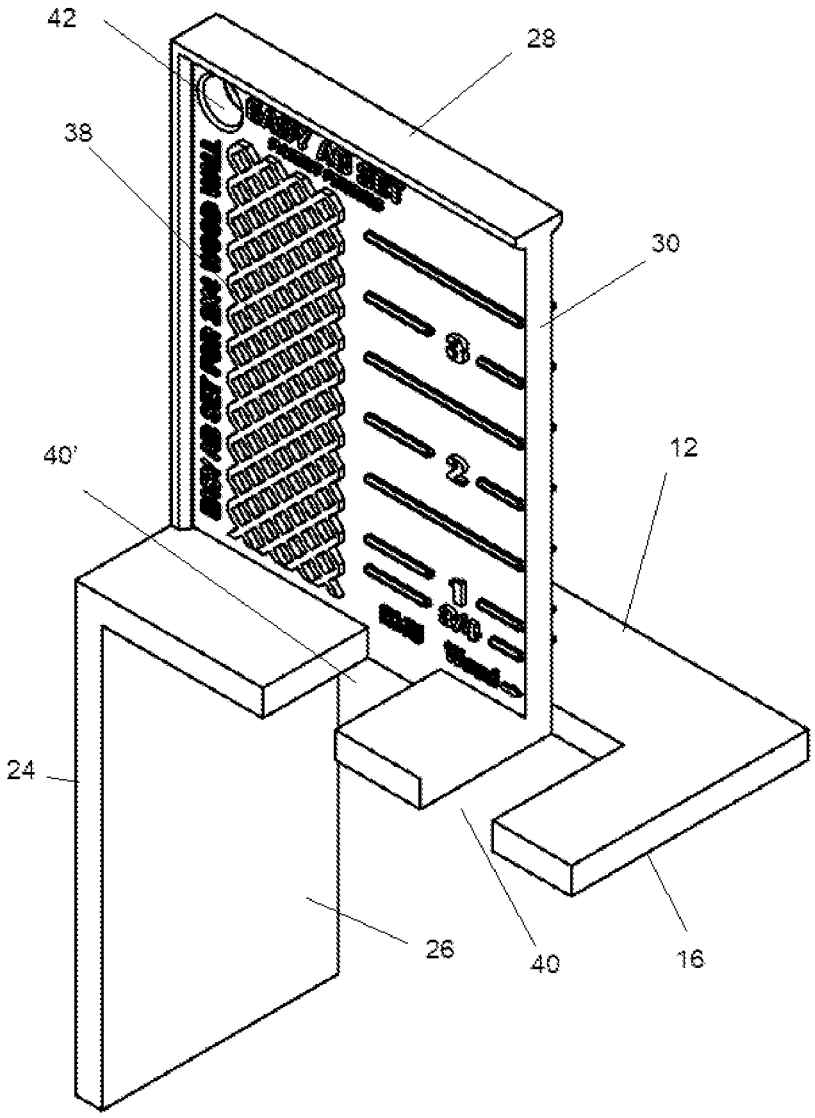
FIG. 9 is a front perspective view of an anchor bolt alignment tool.
Figure 10:
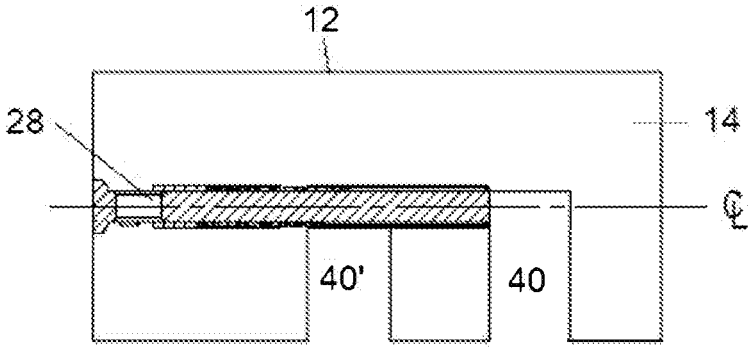
FIG. 10 is a top plan view of the anchor bolt alignment tool.
Figure 11:
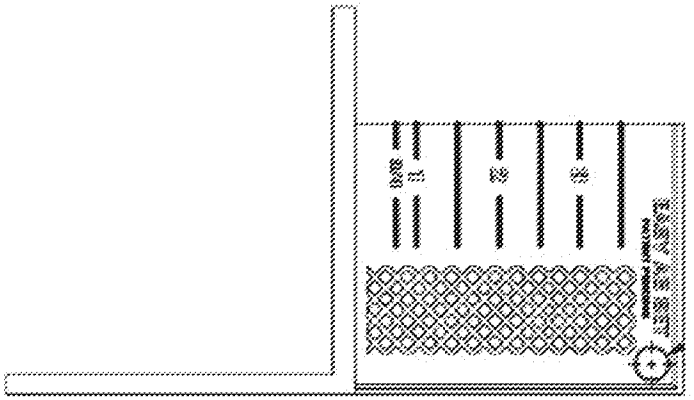
FIG. 11 is a left side elevation view of the anchor bolt alignment tool.
Figure 12:
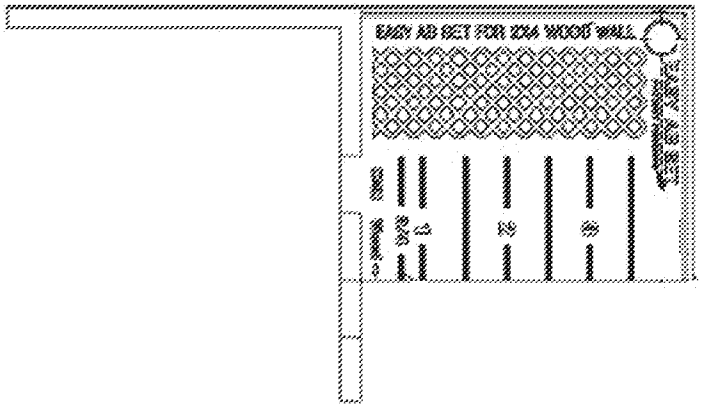
FIG. 12 is a right side elevation view of the anchor bolt alignment tool.
Figure 13:
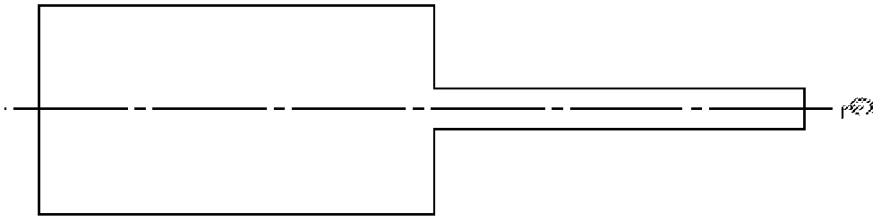
FIG. 13 a rear elevation view of the anchor bolt alignment tool.
Figure 14:
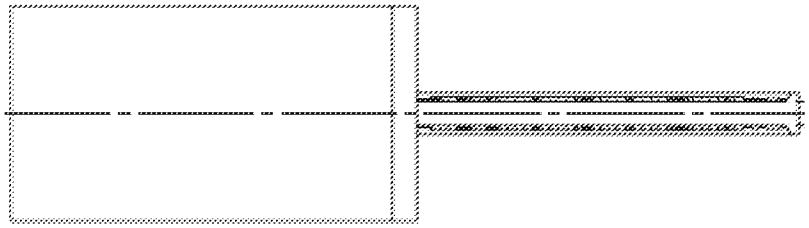
FIG. 14 is a front elevation view of the anchor bolt alignment tool.

A non-limiting embodiment of the anchor bolt alignment tool 10 is shown in reference to the drawings of FIGS. 1-14. The anchor bolt alignment tool 10 has a base 12 that may be formed as a flat plate having a top surface 14 and a bottom surface 16. The bottom surface 16 is arranged for placement and alignment with a surface of the substrate 20, such as concrete, in which the anchor bolt 22 is to be positioned and aligned.

A lateral alignment guide 24 extends downwardly from the bottom surface 16 of the base 12 and has a flat inner surface 26 that is oriented orthogonal to the bottom surface in each of a vertical and a longitudinal axis of the base 12. The flat inner surface 26 of the lateral alignment guide 24 is oriented for placement in abutment with a lateral side edge of the substrate 20 or a frame forming member for the substrate 20. The lateral alignment guide 24 may be in a fixed position relative to the base 12 or laterally adjustable therewith.

A vertical alignment guide 28 extends upwardly from the top surface of the base 12. The vertical alignment guide 28 is oriented orthogonal from the top surface 14 of the base 12 in each of a vertical and a lateral axis of the base 12. An inboard edge 30 of the vertical alignment guide 28 may have graduated markings 32 measuring one or more vertical dimensions above the base 12. The graduated markings 32 provide a desired vertical spacing of a top end 34 of the anchor bolt 22 above the surface of the substrate 20. A plurality of protrusions 38 disposed in a spaced apart relation extend from a face of the vertical alignment guide 28. The multiple protrusions 38 provide a gripping portion for the user to grasp the anchor bolt alignment tool 10. The vertical alignment guide 28 may also be provided with an aperture 42. The aperture 42 may be utilized for hanging the anchor bolt alignment tool 10 from a storage hook. The aperture 42 may also be utilized for receiving an end of a lanyard or similar device for suspension of the anchor bolt alignment tool 10 on a user's tool belt.

In some embodiments, the inboard edge 30 of the vertical alignment guide 28 is positioned at a desired lateral offset of the anchor bolt 22 from the lateral alignment guide, corresponding to a desired lateral offset from the side edge of the substrate 20. The base 12 has a notch 40 defined at the desired lateral offset from the lateral alignment guide. Preferably, an edge of the notch 40 is defined at the inboard edge 30 of the vertical alignment guide 28. In some embodiments, the anchor bolt alignment tool 10 may have a second notch 40' defined at an intermediate position between the inboard edge 30 of the vertical alignment guide 28 and the lateral alignment guide 24.

The notch 40 and the second notch 40' may be spaced apart by a distance corresponding to standard substrate frames to allow the anchor bolt alignment tool 10 to be utilized with different substrate framing materials. By way of non limiting example, the notch 40 and second notch 40' may be spaced apart four use with either 2×4 substrate framing or 1×4 substrate framing so that the anchor bolt 22 is positioned at the desired lateral offset from an edge of the substrate 20. Alternatively, the second notch 40' may be offset for use with a standard residential type header block form concrete masonry unit (CMU).

In use, while the substrate 20, such as concrete, is still in a state of plasticity, the lateral placement guide 24 of the anchor bolt alignment tool 10 is positioned along a side edge of the substrate 20, or a framing member 25 for containing the substrate 20 with a vertical alignment guide 28 position at a specified longitudinal length of the substrate 20. The bottom surface 16 of the base 12 is positioned in aligned abutment with the top surface of the substrate 20. The inner surface 26 of the lateral alignment guide 24 is positioned in abutment with the side edge of the substrate 20.

With the anchor bolt alignment tool 10 properly positioned, an intermediate section of the anchor bolt 22 is positioned for reception in the notch 40 with a bottom end 35 of the anchor bolt 22 embedded in the substrate 20. The axial centerline of the anchor bolt 22 is aligned with the inboard edge 30 of the vertical alignment guide 28. The top end 34 of the anchor bolt 12 is positioned at the desired vertical distance above the substrate 20 by positioning the top end 34 in alignment with a corresponding graduated marking 32 of the vertical alignment guide 28.

As will be appreciated, the anchor bolt alignment tool 10 may be formed of a metallic, plastic, or other suitable material. The material may be selected to limit adherence of a concrete material and/or permit rinsing of the anchor bolt alignment tool 10 for removal of any concrete slurry material that may be adhered.

Once the anchor bolt 22 has been positioned and aligned, the anchor bolt alignment tool 10 may be removed from the substrate 20 and repositioned to the next anchor bolt 22 location for installation of a subsequent anchor bolt.

It should be understood, of course, that the foregoing relates to exemplary embodiments of the invention and that modifications may be made without departing from the spirit and scope of the invention as set forth herein.

I claim:

1. An anchor bolt alignment tool, comprising:

a base formed as a plate having a top surface and a bottom surface, the bottom surface arranged for placement with a top surface of a substrate;

a lateral alignment guide extends downwardly from the bottom surface of the base, the lateral alignment guide having a flat inner surface oriented orthogonal to the bottom surface of the base;

a vertical alignment guide extending upwardly from the top surface of the base, a notch defined in the base, the notch having a width corresponding to a diameter of an anchor bolt aligned by the anchor bolt alignment tool.

2. The anchor bolt alignment tool of claim 1, further comprising:

one or more graduated markings disposed in a spaced apart relation along the vertical alignment guide.

3. The anchor bolt alignment tool of claim 1, further comprising:

a gripping portion disposed on at least one of a front surface and a back surface of the vertical alignment guide.

4. The anchor bolt alignment tool of claim 3, wherein the gripping portion comprises:

a plurality of protrusions extending from the at least one of the front surface and the back surface of the vertical alignment guide.

5. The anchor bolt alignment tool of claim 1, wherein the notch is disposed at a desired lateral offset of the anchor bolt from the lateral alignment guide.

6. The anchor bolt alignment tool of claim 5, further comprising:

an inboard edge of the vertical alignment guide aligned with a side edge of the notch.

7. An anchor bolt alignment tool, comprising:

a base having a bottom surface arranged for a horizontal alignment with a top surface of a substrate;

a lateral alignment guide arranged for a vertical alignment with a side edge of the substrate, the lateral alignment guide oriented orthogonal to the bottom surface of the base;

a vertical alignment guide elevated from a top surface of the base, a notch defined in the base, the notch disposed at a desired lateral offset from the lateral alignment guide.

8. The anchor bolt alignment tool of claim 7, further comprising:

one or more graduated markings vertically disposed in a spaced apart relation along the vertical alignment guide.

9. The anchor bolt alignment tool of claim 8, further comprising:

a gripping portion disposed on at least one of a front surface and a back surface of the vertical alignment guide.

10. The anchor bolt alignment tool of claim 9, wherein the gripping portion comprises:

a plurality of protrusions extending from the at least one of the front surface and the back surface of the vertical alignment guide.

11. The anchor bolt alignment tool of claim 7, wherein the lateral alignment guide is adjustably coupled with the base.

12. The anchor bolt alignment tool of claim 7, further comprising:

an inboard edge of the vertical alignment guide is aligned with a side edge of the notch.

* * * * *